US007430781B2

(12) United States Patent
Collins

(10) Patent No.: US 7,430,781 B2
(45) Date of Patent: Oct. 7, 2008

(54) WINDOW BLIND CLEANING SYSTEM

(76) Inventor: Linda M. Collins, 5730 W. Centinela Ave., #405, Los Angeles, CA (US) 90045

( * ) Notice: Subject to any disclaimer, the term of this patent is extended or adjusted under 35 U.S.C. 154(b) by 532 days.

(21) Appl. No.: 11/139,380

(22) Filed: May 27, 2005

(65) Prior Publication Data

US 2006/0130259 A1 Jun. 22, 2006

Related U.S. Application Data

(60) Provisional application No. 60/637,626, filed on Dec. 18, 2004.

(51) Int. Cl.
*A47L 4/02* (2006.01)

(52) U.S. Cl. ..... 15/220.3

(58) Field of Classification Search ..... 15/220.3
See application file for complete search history.

(56) References Cited

U.S. PATENT DOCUMENTS

| | | | | |
|---|---|---|---|---|
| 2,541,448 | A | 2/1951 | Verzal | |
| 2,546,526 | A | 3/1951 | Shirley | |
| 2,579,870 | A | 12/1951 | Schneider | |
| 2,658,221 | A | 11/1953 | Nicoli | |
| 2,723,412 | A | 11/1955 | Harris | |
| 2,788,537 | A | 4/1957 | Greenberg | |
| 2,819,484 | A | 1/1958 | Fouse | |
| 2,957,190 | A | 10/1960 | Stark | |
| 3,075,223 | A * | 1/1963 | Warner | 15/220.3 |
| D328,373 | S | 7/1992 | Murray | |
| 5,369,836 | A | 12/1994 | Horne | |
| 5,839,147 | A | 11/1998 | Chia-Yi et al. | |

* cited by examiner

*Primary Examiner*—Randall Chin
(74) *Attorney, Agent, or Firm*—David A. Belasco; Belasco Jacobs & Townsley, LLP

(57) ABSTRACT

A window blind cleaning system for cleaning the slats of vertical or horizontal blinds of varying heights, with a user selected cleaning material placed over the cleaning heads, which the user remotely actuates to close the cleaning surfaces onto the slats to be cleaned. The system includes a handle, an extension handle, handle mounted trigger, actuating link, backing plates with attached cleaning pads forming the cleaning heads. Resilient supporting arms urge the cleaning heads apart and the trigger operated actuating link urges the cleaning heads together about the slat. A resilient U-shaped restraining bar may be used to further urge the cleaning heads apart. The cleaning pads and covers over them are removably attached. The backing plates and cleaning pads are shaped to conform to the blind slats. The primary handle is formed from multiple sections. Assembled together, these sections form a single handle allowing the user greater cleaning reach.

19 Claims, 10 Drawing Sheets

10
34
18
106
106
14
106
30
78
38
42
58
82

WINDOW BLIND CLEANING SYSTEM

PRIOR APPLICATION

The instant application claims priority from U.S. Provisional Application Ser. No. 60/637,626 filed Dec. 18, 2004.

FIELD OF INVENTION

The present invention relates generally to window blind cleaners and more specifically it relates to a window blind cleaning system with interchangeable cleaning heads for cleaning the slats of vertical or horizontal blinds of varying heights, with a user selected cleaning material placed over the cleaning heads which the user remotely actuates using minimal pressure to close the cleaning surfaces onto the slat surface to be cleaned.

BACKGROUND OF THE INVENTION

It can be appreciated that window blind cleaners have been in use for years. Typically, window blind cleaners are comprised of devices resembling tongs with sponges attached to the ends. A horizontal window blind cleaner has a short handle with multiple brushes. Another product has an elongated handle and a cleaning surface positioned at a right angle to the handle and is meant for dusting ceiling fans. Yet another type of window blind cleaner has multiple brushes with a vacuum cleaner attachment. Still another system for cleaning vertical blinds allows the user to hang vertical blinds in a shower and run water on the blinds until they are clean.

The main problem with conventional window blind cleaners is that they do not allow the user versatility in the type of cleaning product to apply to the window blind slat surface. In addition, they do not allow users to easily reach and clean window blind slats at varying heights. Yet another problem is that existing products require the user to apply consistent full hand pressure to handles to close the devices for cleaning. Another problem with conventional window blind cleaners is limited control over the amount of pressure needed to close the cleaning surfaces together during the cleaning process. Further, with conventional blind cleaning systems, the blinds must often be removed from the window for cleaning.

Yet another problem is that existing products require the user to apply consistent full hand pressure to handles to close the devices for cleaning. Still another problem is that the user has no control over varying the type of cleaning provided by the cleaning heads, or, varying the type of cleaning head used. Also, another problem is limited control over the type of pressure needed to close the cleaning surfaces together during the cleaning process.

In these respects, the window blind cleaning system according to the present invention substantially departs from the conventional concepts and designs of the prior art, and in so doing addresses all of the problems identified above.

U.S. Pat. No. 5,369,836, issued to Horne, discloses a ceiling fan blade cleaner including a flexible, flat tubular, textile sleeve of sufficient length to completely encase a fan blade from tip to root, a flat spring member to cause said sleeve to conform to the blade surfaces and a pair of metal plates to releasably engage the root end of said sleeve and to withdraw said sleeve in wiping engagement with the surfaces of said blade to remove dirt therefrom and to trap such dirt as it is removed.

U.S. Pat. No. 5,839,147, issued to Chia-Yi, et al., is directed to a mopping device includes a first part and a second part pivotally connected to the first part from which a handle is pivotally disposed. Two connecting members and a torsion spring are respectively pivotally connected between the first and the second part so that the second part is foldable toward the first part. Each of the first part and the second part has at least one clamping member pivotally connected thereto such that a cleaning member is securely disposed to an underside of the first and the second part by being clamped by the two clamping members.

U.S. Pat. No. D328,373, issued to Murray, discloses an ornamental design for a ceiling fan duster It is an objective of the present invention to provide a system for cleaning slats of vertical or horizontal blinds of varying heights. It is a further objective to provide a system that allows for use of varying cleaning materials that are removably attached to the cleaning heads of the system. It is a still further objective of the invention to provide a system that will provide an efficient means to apply uniform pressure to the blind slats through a remote actuator. Finally, it is an objective to a system that can introduce cleaning fluids onto the system cleaning heads.

While some of the objectives of the present invention are disclosed in the prior art, none of the inventions found include all of the requirements identified.

SUMMARY OF THE INVENTION

The present invention addresses all of the deficiencies of prior art window blind cleaning systems inventions and satisfies all of the objectives described above.

(1) A window blind cleaning system providing the desired features can be constructed from the following components. First and second backing plates are provided. Each of the backing plates has an inner surface and an outer surface. The inner surfaces are sized and shaped to conform to a shape of a window blind. First and second cleaning pads are provided. The cleaning pads are sized and shaped to cover the inner surfaces. Means are provided for attaching the cleaning pads to the inner surfaces.

First and second support arms are provided. Each of the support arms has an upper end, a lower end and is formed of resilient material. Each of the support arms is pivotally mounted to one of the outer surfaces of the backing plates at the upper end and fixedly attached adjacent a first end of a handle at the lower end. First and second toggle links are provided. The toggle links have inner and outer ends, are pivotally attached at their outer ends to the first and second support arms, respectively, between their upper and lower ends. The toggle links are pivotally attached at their inner ends to a first end of an actuating link. The actuating link is located substantially parallel to the handle and connecting at a second end to a trigger. The trigger is pivotally attached adjacent a second end of the handle.

The trigger moves the actuating link from an extended position, allowing the support arms to separate the backing plates, to a retracted position, closing the backing plates with attached cleaning pads about the window blind against outward urging of the support arms. When the trigger moves the actuating link to the retracted position the first and second cleaning pads will be clamped on either side of the window blind and are movable along a length of the blind for cleaning. When the trigger moves the actuating link to the extended position, the support arms will separate the backing plates and the cleaning pads from the blind for removal from the blind slat.

(2) In a variant of the invention, the inner surface of the first backing plate is concave and the inner surface of the second backing plate is convex.

(3) In another variant, the backing plates are substantially rectangular in shape.

(4) In still another variant, the backing plates are substantially circular in shape and are rotatably mounted to the support arms.

(5) In a further variant, the cleaning pads are removably attached to the inner surfaces using means selected from the group consisting of:

adhesive, snaps, hook and loop fasteners, snap-on brackets and clamps.

(6) In still a further variant, a plurality of attachment slots are located on the outer surface of the backing plates for attaching a cleaning cloth over the cleaning pads.

(7) In another variant of the invention, the cleaning pads are sponge-like air-filled members.

(8) In still another variant, the handle is comprised of at least two sections that are removably joined together to provide a compact system capable of extended reach.

(9) In a further variant, the handle includes at least two telescoping sections that extend to vary a length of the handle.

(10) In still a further variant, the second end of the handle is adapted to fit a handle extension to further extend a reach of the system.

(11) In another variant of the invention, the trigger includes a cam-locking mechanism. The mechanism maintains the actuating link in the retracted position against the outward urging of the support arms.

(12) In still another variant, the trigger is a pivoting lever attached adjacent the second end of the handle.

(13) In a further variant, the trigger is a sliding sleeve disposed about the handle adjacent the second end of the handle.

(14) In still a further variant, the actuating link is disposed adjacent an outer surface of the handle.

(15) In another variant of the invention, the actuating link is located within a hollow core of the handle.

(16) In still another variant, the window blind cleaning system includes a U-shaped restraining bar. The restraining bar is formed of resilient material, extending from the outer surface of the first backing plate to the outer surface of the second backing plate and further urging the backing plates apart.

(17) In a further variant, the backing plates with attached cleaning pads are removably attached to the support arms.

(18) In still a further variant, the window blind cleaning system further includes a container. The container holds a cleaning fluid and is secured to the handle. A tube extends from the container to at least one of the cleaning pads. When the bottle is tilted or squeezed, a quantity of cleaning fluid is dispensed onto the cleaning pad.

(19) In a final variant of the invention, a window blind cleaning system includes first and second backing plates. Each of the backing plates has an inner surface and an outer surface. The inner surfaces are sized and shaped to conform to a shape of a window blind. First and second cleaning pads are provided. The cleaning pads are sized and shaped to cover the inner surfaces. Means are provided for attaching the cleaning pads to the inner surfaces. First and second support arms are provided. Each of the support arms has an upper end, a lower end, is formed of resilient material, is pivotally mounted to one of the outer surfaces at the upper end and fixedly attached adjacent a first end of a handle at the lower end.

The first support arm holds the first backing plate with attached cleaning pad in a fixed position. The second support arm further includes a pivot point. The pivot point is located outwardly from a centerline of the handle. An actuating arm is provided. The arm has a top end, a bottom end, a point of rotation. The arm is pivotally mounted to the second support arm at the pivot point, bearing against the outer surface of the second backing plate at the top end and attached to a first end of an actuating link at the bottom end. The actuating link is located substantially parallel to the handle and connects at a second end to a trigger. The trigger is pivotally attached adjacent a second end of the handle. The trigger moves the actuating link from an extended position, allowing the second support arm to withdraw the second backing plate from close proximity to the first backing plate, to a retracted position.

In the retracted position the actuating link urges the second backing plate toward the first backing plate and closes the backing plates with attached cleaning pads about the window blind against outward urging of the second support arm. When the trigger moves the actuating link to the retracted position the first and second cleaning pads will be clamped on either side of the window blind and are movable along a length of the blind for cleaning. When the trigger moves the actuating link to the extended position, the support arms will separate the backing plates and the cleaning pads from the blind for removal from the blind slat.

DESCRIPTION OF THE DRAWINGS

DETAILED DESCRIPTION OF THE PREFERRED EMBODIMENT (1) FIGS. 1A-8B illustrate a window blind cleaning system 10 providing the desired features that can be constructed from the following components. First 14 and second 18 backing plates are provided. Each of the backing plates 14, 18 has an inner surface 22 and an outer surface 26. The inner surfaces 22 are sized and shaped to conform to a shape of a window blind (not shown). First 30 and second 34 cleaning pads are provided. The cleaning pads 30,34 are sized and shaped to cover the inner surfaces 22. Means (not shown) are provided for attaching the cleaning pads 30, 34 to the inner surfaces 22.

First 38 and second 42 support arms are provided. Each of the support arms 38,42 has an upper end 46, a lower end 50 and is formed of resilient material. Each of the support arms 38, 42 is pivotally mounted to one of the outer surfaces 26 of the backing plates 14, 18 at the upper end 46 and fixedly attached adjacent a first end 54 of a handle 58 at the lower end 50. First 62 and second 66 toggle links are provided. The toggle links 62, 66 have inner 70 and outer 74 ends, are pivotally attached at their outer ends 74 to the first 38 and second 42 support arms, respectively, between their upper 46 and lower 50 ends. The toggle links 62, 66 are pivotally attached at their inner ends 70 to a first end 78 of an actuating link 82. As illustrated in FIG. 1, the actuating link 82 is located substantially parallel to the handle 58 and connecting at a second end 86 to a trigger 90.

Figure 1A:
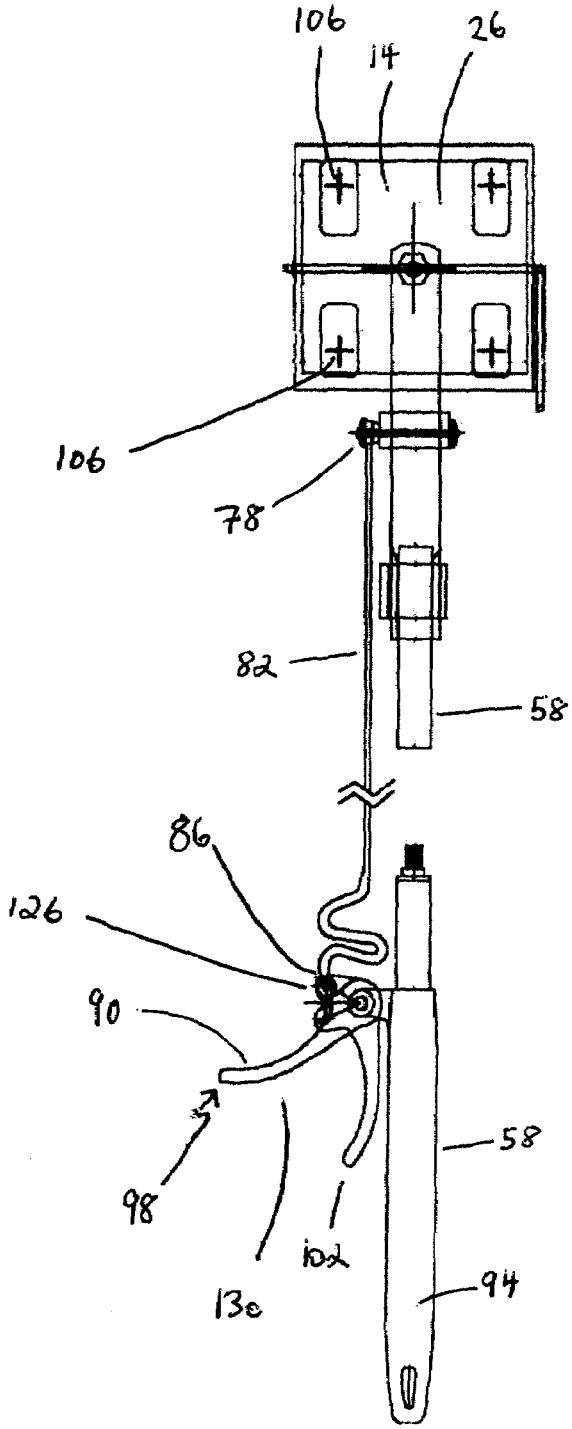
FIG. 1A is a top view of the present invention showing the major components fully assembled.

The trigger 90 is pivotally attached adjacent a second end 94 of the handle 58. The trigger 90 moves the actuating link 82 from an extended position 98, allowing the support arms 38, 42 to separate the backing plates 14, 18, to a retracted position 102, closing the backing plates 14, 18 with attached cleaning pads 30, 34 about the window blind against outward urging of the support arms 38, 42. When the trigger 90 moves the actuating link 82 to the retracted position 102 the first 30 and second 34 cleaning pads will be clamped on either side of the window blind and are movable along a length of the blind for cleaning. When the trigger 90 moves the actuating link 82 to the extended position 98, the support arms 38, 42 will separate the backing plates 14, 18 and the cleaning pads 30, 34 from the blind for removal from the blind slat.

Figure 1B:
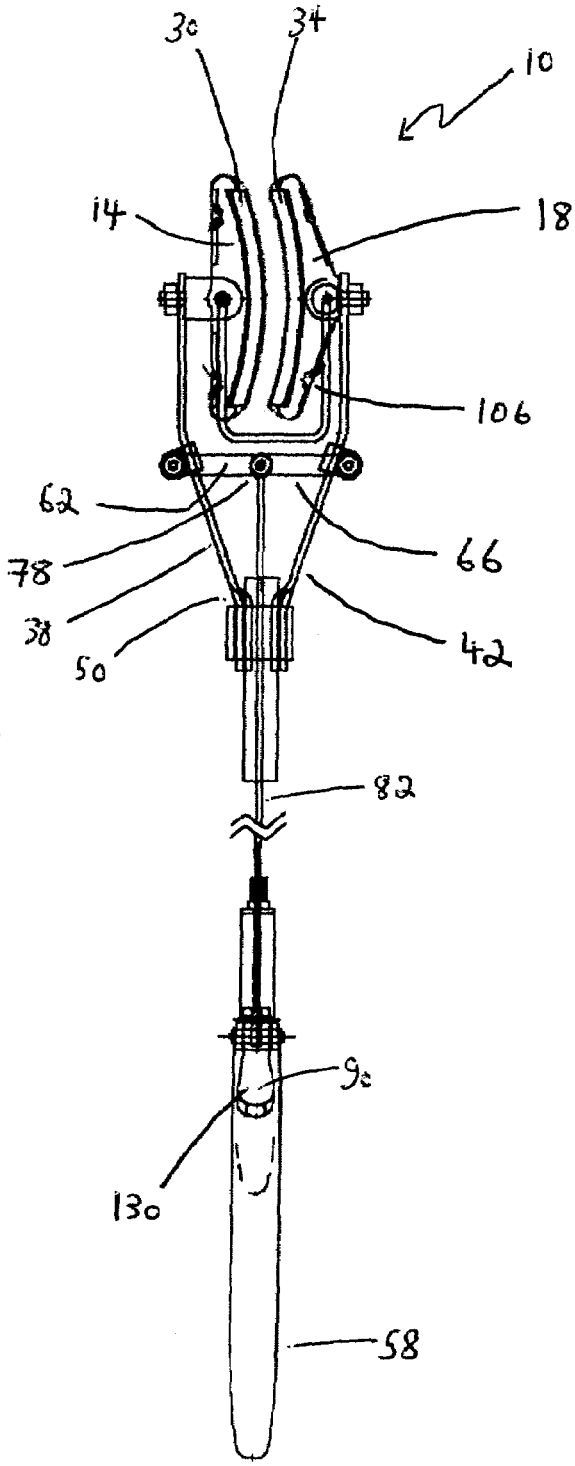
FIG. 1B is a side view of the FIG. 1A embodiment.
Figure 2:
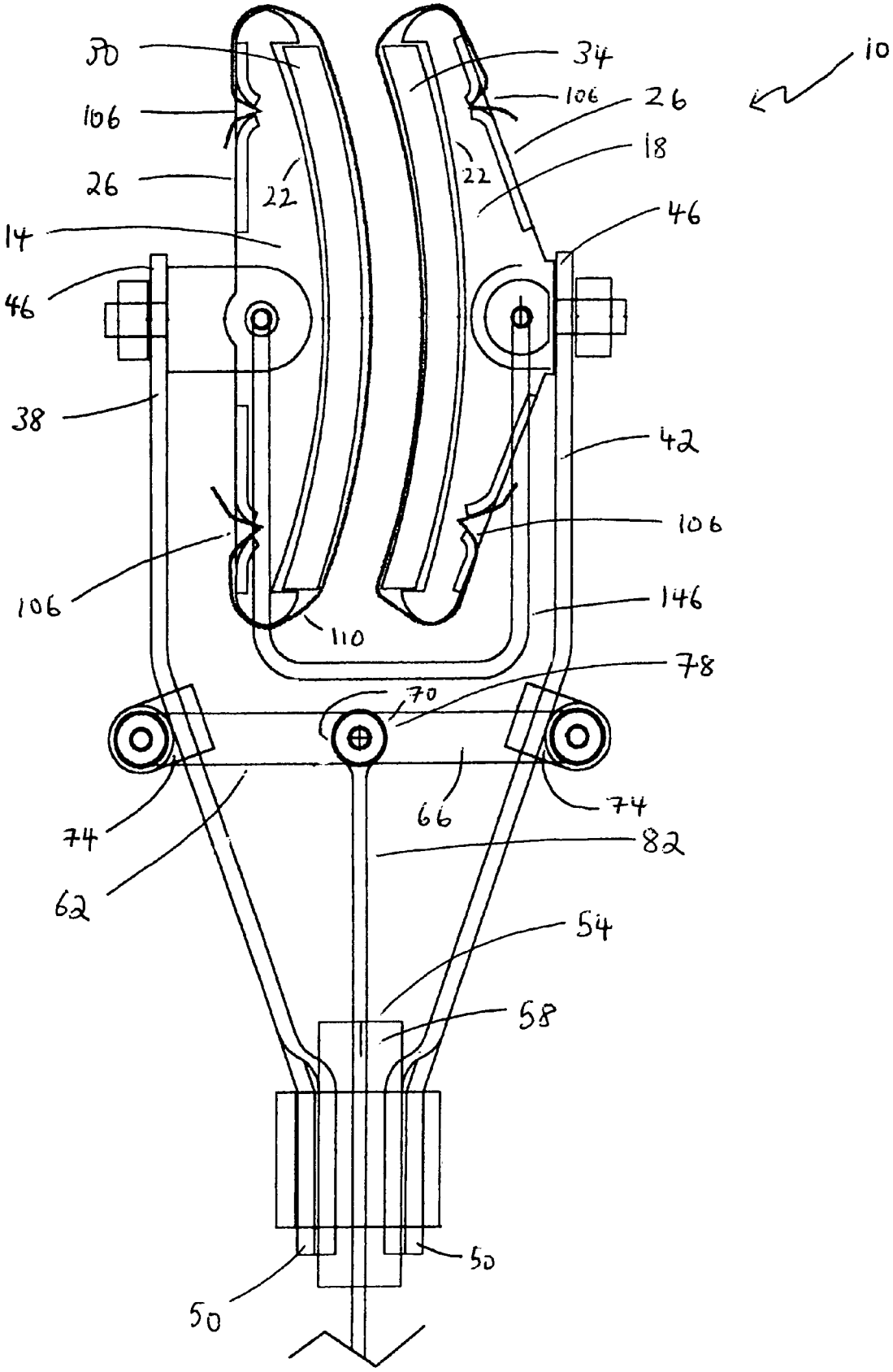
FIG. 2 is a detailed partial top view of the FIG. 1B embodiment showing the cleaning apparatus head.
Figure 3:
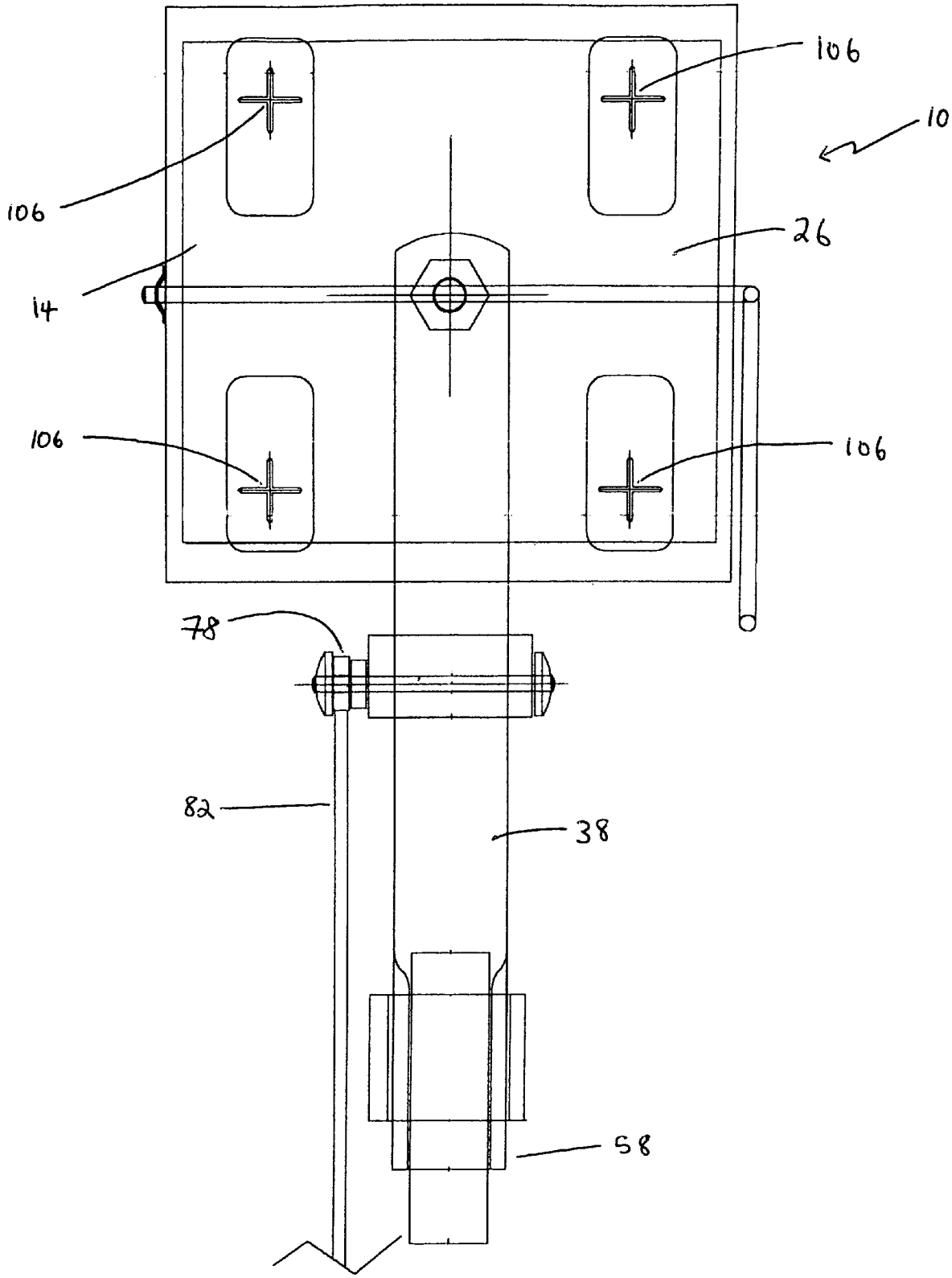
FIG. 3 is a detailed partial side view of the FIG. 1A embodiment showing the cleaning head apparatus.
Figures 4A, 4B:
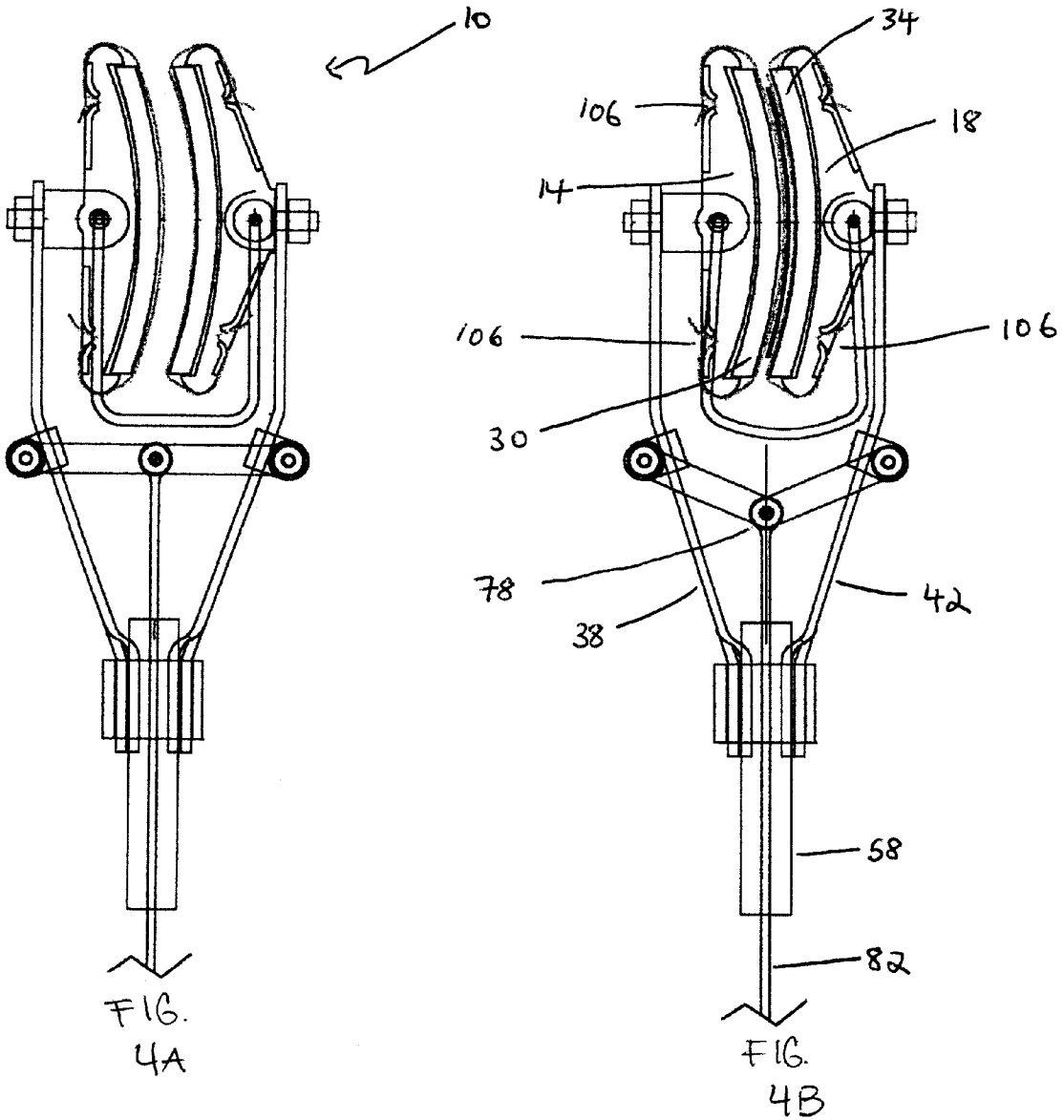
FIG. 4A illustrates the cleaning heads of the FIG. 1A embodiment in the open positions.
FIG. 4B illustrates the cleaning heads of the FIG. 1A embodiment in the closed position.
Figure 5A:
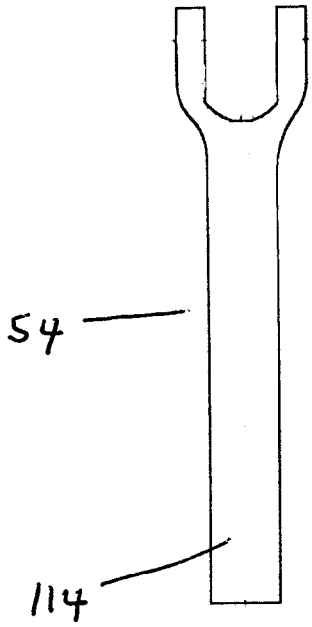
FIG. 5A is a top view of the FIG. 1A embodiment illustrating the upper portion of the handle sections.
Figure 5B:
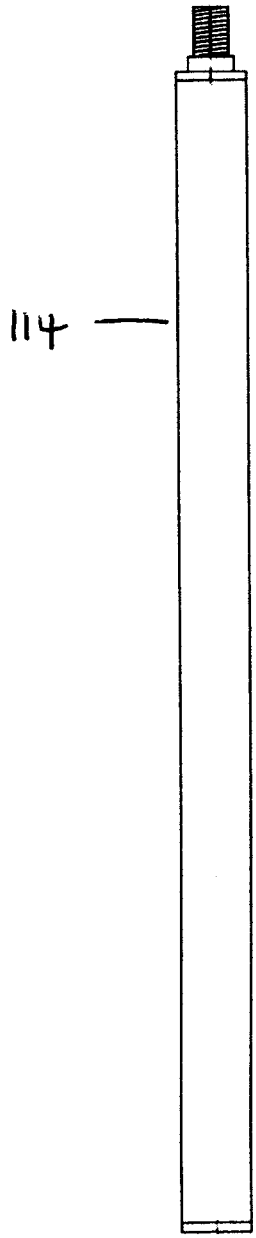
FIG. 5B is a top view of the FIG. 1A embodiment illustrating the middle portion of the handle sections.
Figure 5C:
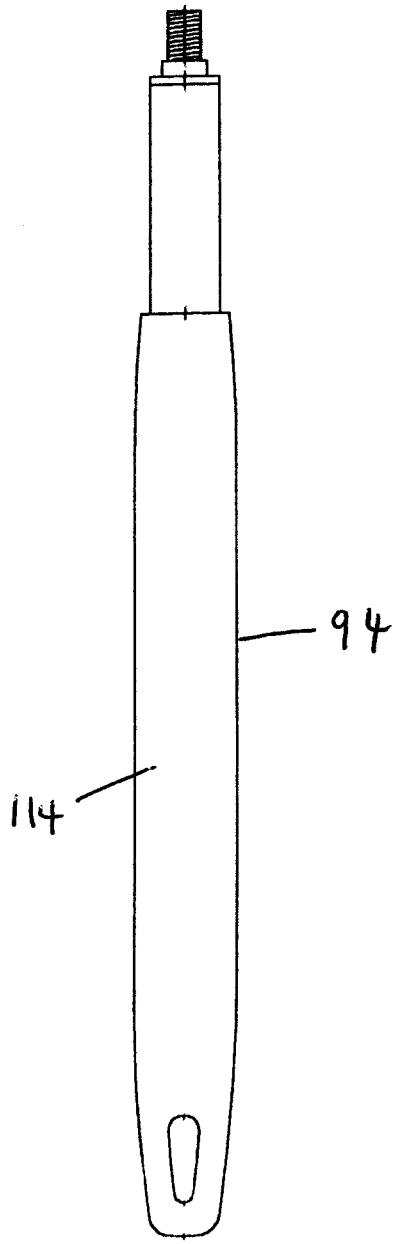
FIG. 5C is a top view of the FIG. 1A embodiment illustrating the lower portion of the handle sections.

(2) In a variant of the invention, as illustrated in FIGS. 1B and 2, the inner surface 22 of the first backing plate 14 is concave and the inner surface 22 of the second backing plate 18 is convex.

Figures 9A, 9B:
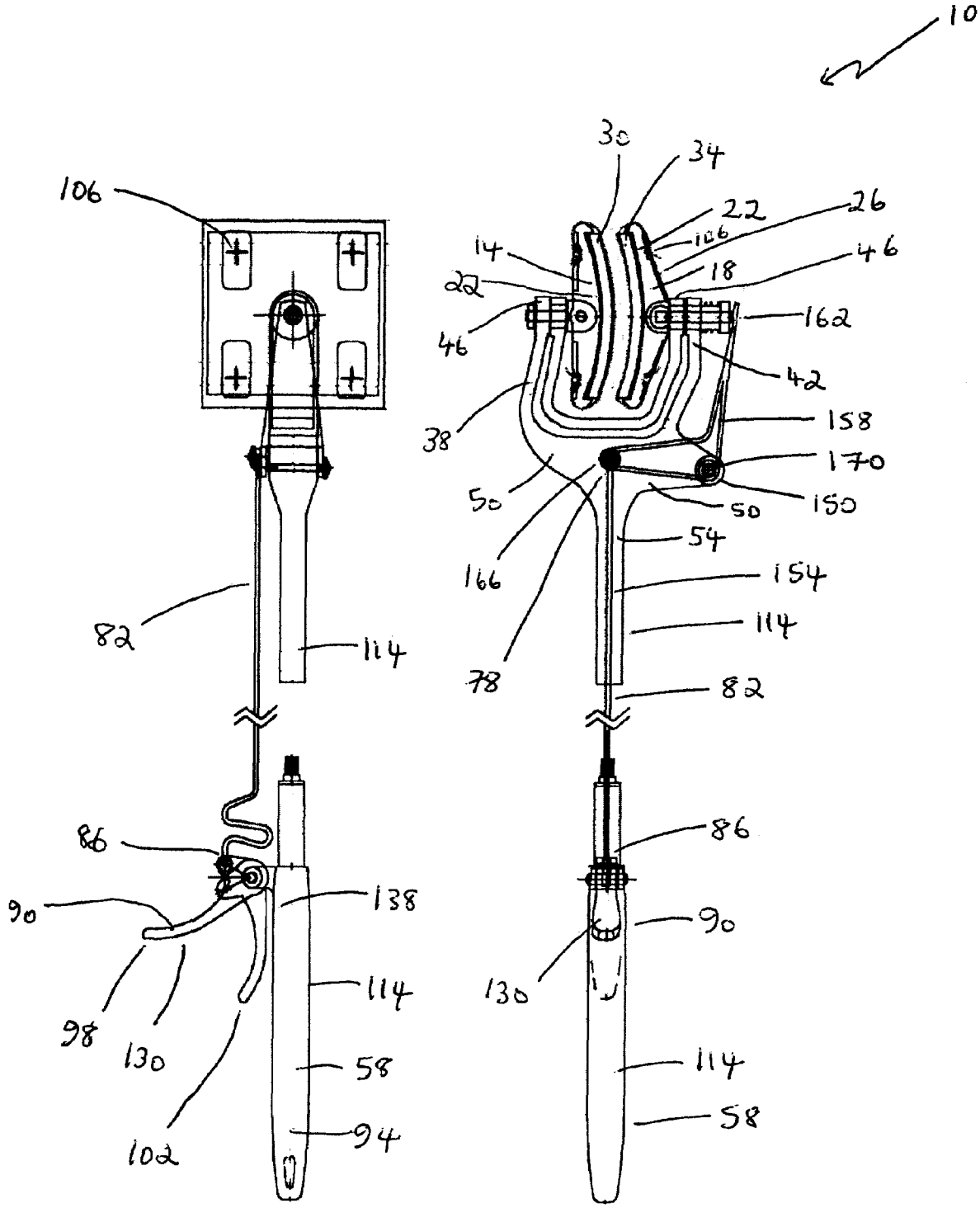
FIG. 9A is a top view of a second embodiment of the present invention made with a single side closing backing plate.
FIG. 9B is side view of the FIG. 9A embodiment.

(3) In another variant, as illustrated in FIGS. 1A, and 9A, the backing plates 14, 18 are substantially rectangular in shape.

Figure 7A:
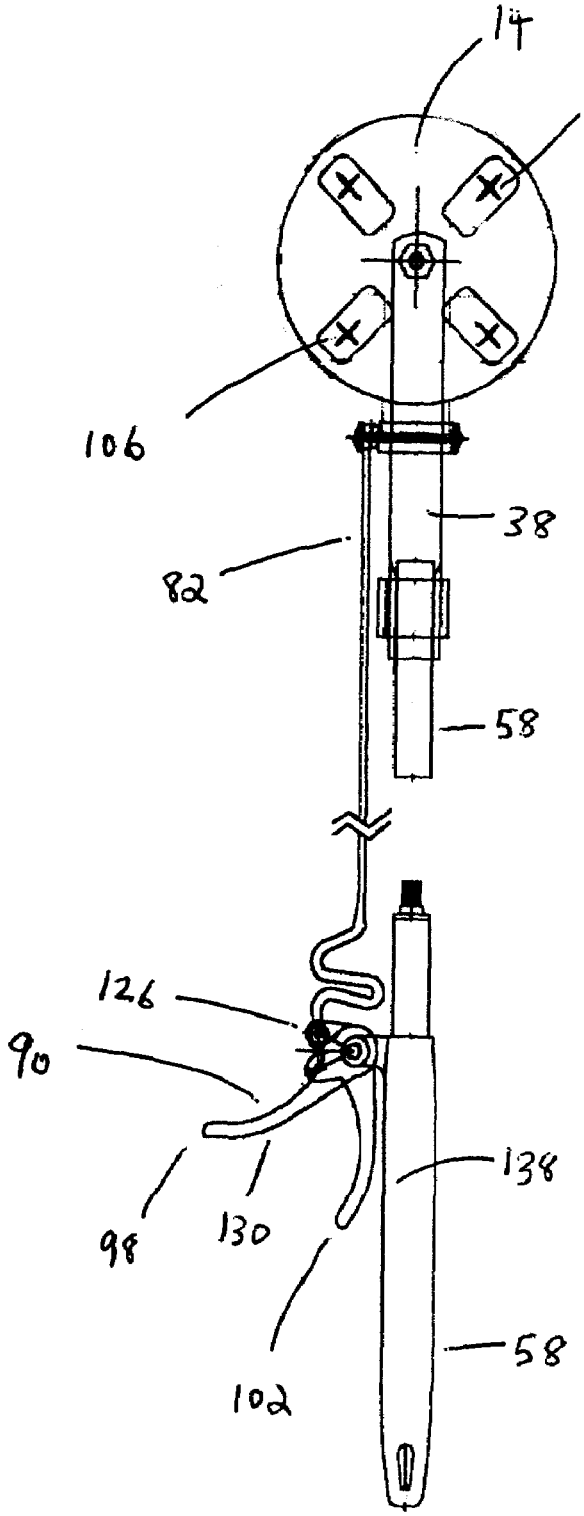
FIG. 7A is is a top view of the present invention made with circular backing plates and cleaning pads.
Figure 7B:
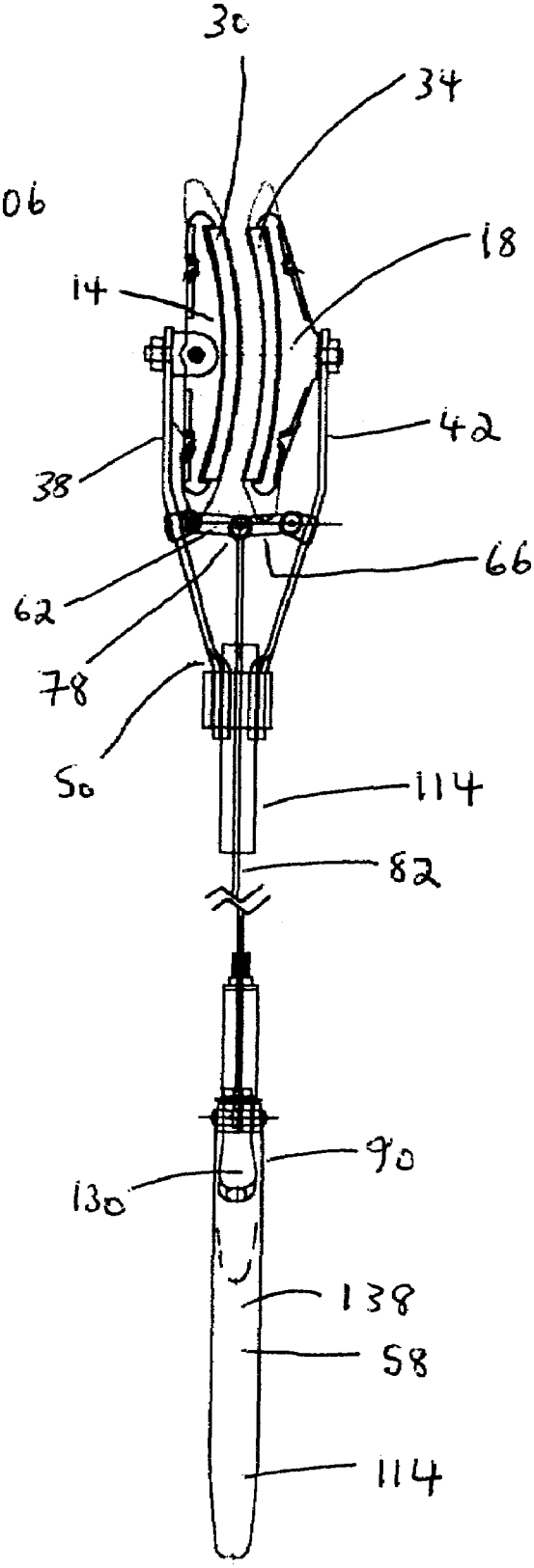
FIG. 7B is is a side view of the present invention made with circular backing plates and cleaning pads.

(4) In still another variant, as illustrated in FIG. 7A, the backing plates 14, 18 are substantially circular in shape and are rotatably mounted to the support arms 38, 42.

(5) In a further variant, as illustrated in FIGS. 1A, 1B, 2, 3,-4A,4B, 7A, 7B, 9A and 9B, the cleaning pads 30, 34 are removably attached to the inner surfaces 22 using means selected from the group consisting of: adhesive, snaps, hook and loop fasteners, snap-on brackets and clamps (all not shown).

(6) In still a further variant, as illustrated in FIGS. 1A, 1B, 2, 3,-4A, 4B, 7A, 7B, 9A and 9B, a plurality of attachment slots 106 are located on the outer surface 26 of the backing plates 14, 18 for attaching a cleaning cloth 110 over the cleaning pads 30, 34.

(7) In another variant of the invention, the cleaning pads 30, 34 are sponge-like air-filled members.

(8) In still another variant, as illustrated in FIGS. 5A, 5B, 5C, 6-7A, 7B, 8B and 9A and 9B, the handle 58 is comprised of at least two sections 114 that are removably joined together to provide a compact system 10 capable of extended reach.

Figure 8A:
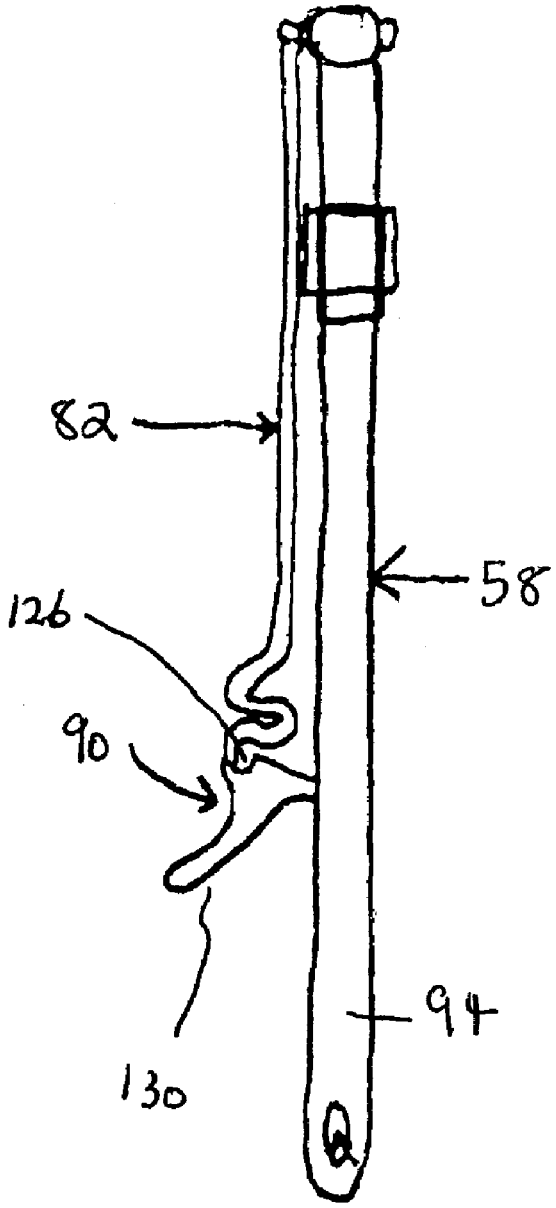
FIG. 8A is a top view of the present invention made with a solid handle.
Figure 8B:
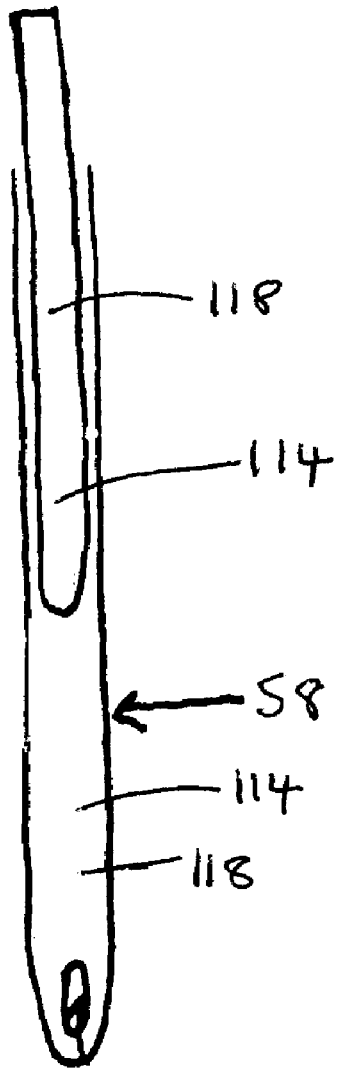
FIG. 8B is a top view of the present invention made with a a telescoping handle.

(9) In a further variant, as illustrated in FIG. 8B, the handle 58 includes at least two telescoping sections 118 that extend to vary a length of the handle 58.

Figure 6:
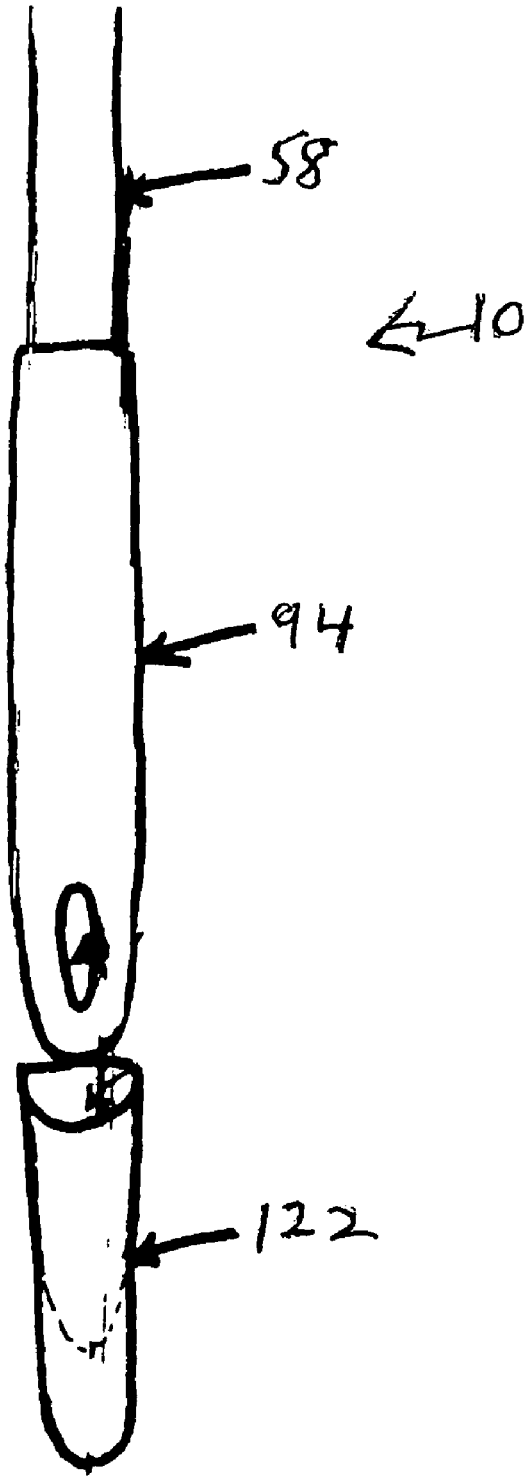
FIG. 6 is a side view of the FIG. 1 embodiment illustrating an extension handle.

(10) In still a further variant, as illustrated in FIG. 6, the second end 94 of the handle 58 is adapted to fit a handle extension 122 to further extend a reach of the system 10.

(11) In another variant of the invention, as illustrated in FIGS. 1A,[-]7A, 8A and 9A, the trigger 90 includes a cam-locking mechanism 126. The mechanism 126 maintains the actuating link 82 in the retracted position 102 against the outward urging of the support arms 38, 42.

(12) In still another variant, as illustrated in FIGS. 1A, 1B, [-]7A, 7B, 8A and 9A and 9B, the trigger 90 is a pivoting lever 130 attached adjacent the second end 94 of the handle 58.

Figure 10:
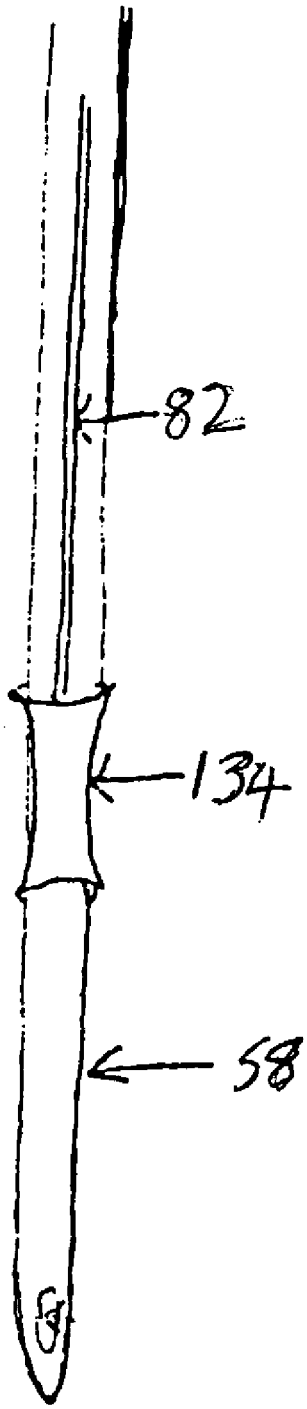
FIG. 10 is an illustration of the present invention with a sliding trigger to close the cleaning heads.

(13) In a further variant, as illustrated in FIG. 10, the trigger 90 is a sliding sleeve 134 disposed about the handle 58 adjacent the second end 94 of the handle.

(14) In still a further variant, as illustrated in FIGS. 1A, 1B, 2, 3,-4A, 4B, 7A, 7B, 8A, 9A and 9B and 10, the actuating link 82 is disposed adjacent an outer surface 138 of the handle 58.

(15) In anoiher variant of the invention, the actuating link 82 is located within a hollow core (not shown) of the handle 58.

(16) In still another variant, as illustrated in FIG. 2, the window blind cleaning system 10 includes a U-shaped restraining bar 146. The restraining bar 146 is formed of resilient material, extending from the outer surface 26 of the first backing plate 14 to the outer surface 26 of the second backing plate 18 and further urging the backing plates 14, 18 apart.

(17) In a further variant, as illustrated in FIGS. 1A, 1B,2, 3,-4A, 4B, 7A, 7B and 9A and 9B, the backing plates 14, 18 with attached cleaning pads 30, 34 are removably attached to the support arms 38, 42.

(18) In still a further variant, the window blind cleaning system 10 further includes a container (not shown). The container holds a cleaning fluid and is secured to the handle 58. A tube (not shown) extends from the container to at least one of the cleaning pads 30, 34. When the bottle is tilted or squeezed, a quantity of cleaning fluid is dispensed onto the cleaning pad 30, 34.

(19) In a final variant of the invention, as illustrated in FIGS. 9A and 9B, a window blind cleaning system 10 includes first 14 and second 18 backing plates. Each of the backing plates 14, 18 has an inner surface 22 and an outer surface 26. The inner surfaces 22 are sized and shaped to conform to a shape of a window blind (not shown). First 30 and second 34 cleaning pads are provided. The cleaning pads 30, 34 are sized and shaped to cover the inner surfaces 22. Means (not shown) are provided for attaching the cleaning pads 30, 34 to the inner surfaces 22. First 38 and second 42 support arms are provided. Each of the support arms 38, 42 has an upper end 46, a lower end 50, is formed of resilient material, is pivotally mounted to one of the outer surfaces 26 at the upper end 46 and fixedly attached adjacent a first end 54 of a handle 58 at the lower end 50.

The first support arm 38 holds the first backing plate 14 with attached cleaning pad 30 in a fixed position. The second support arm 42 further includes a pivot point 150. The pivot point 150 is located outwardly from a centerline 154 of the handle 58. An actuating arm 158 is provided. The arm 158 has a top end 162, a bottom end 166 and a point of rotation 170. The arm 158 is pivotally mounted to the second support arm 42 at the pivot point 150, bearing against the outer surface 26 of the second backing plate 18 at the top end 162 and attached to a first end 174 of an actuating link 82 at the bottom end 166. The actuating link 82 is located substantially parallel to the handle 58 and connects at a second end 86 to a trigger 90. The trigger 90 is pivotally attached adjacent a second end 94 of the handle 58. The trigger 90 moves the actuating link 82 from an extended position 98, allowing the second support arm 42 to withdraw the second backing plate 18 from close proximity to the first backing plate 14, to a retracted position 102.

In the retracted position 102 the actuating link 82 urges the second backing plate 18 toward the first backing plate 14 and closes the backing plates 14, 18 with attached cleaning pads 30,34 about the window blind ( not shown) against outward urging of the second support arm 42. When the trigger 90 moves the actuating link 82 to the retracted position 102 the first 30 and second 34 cleaning pads will be clamped on either side of the window blind and are movable along a length of the blind for cleaning. When the trigger 90 moves the actuating link 82 to the extended position 98, the support arms 38, 42 will separate the backing plates 14, 18 and the cleaning pads 30,34 from the blind for removal from the blind slat.

The invention claimed is:

1. A window blind cleaning system, comprising:

first and second backing plates, each of the backing plates having an inner surface and an outer surface;

the inner surfaces being sized and shaped to conform to a shape of a window blind;

first and second cleaning pads, the cleaning pads being sized and shaped to cover the inner surfaces;

means for attaching the cleaning pads to the inner surfaces;

first and second support arms, each of the support arms having an upper end, a lower end, being formed of resilient material, pivotally mounted to one of the outer surfaces at the upper end and fixedly attached adjacent a first end of a handle at the lower end;

first and second toggle links, the toggle links having inner and outer ends, being pivotally attached at the outer ends to the first and second support arms, respectively, between the upper and lower ends and pivotally attached at the inner ends to a first end of an actuating link;

the actuating link being disposed substantially parallel to the handle and connecting at a second end to a trigger, the trigger being pivotally attached adjacent a second end of the handle;

the trigger moving the actuating link from an extended position, allowing the support arms to separate the backing plates, to a retracted position, closing the backing plates with attached cleaning pads about the window blind against outward urging of the support arms; and whereby, when the trigger moves the actuating link to the retracted position the first and second cleaning pads will be clamped on either side of the window blind and are movable along a length of the blind for cleaning, and when the trigger moves the actuating link to the extended position, the support arms will separate the backing plates and the cleaning pads from the blind for removal therefrom.

2. The window blind cleaning system, as described in claim 1, wherein the inner surface of the first backing plate is concave and the inner surface of the second backing plate is convex.

3. The window blind cleaning system, as described in claim 1, wherein the backing plates are substantially rectangular in shape.

4. The window blind cleaning system, as described in claim 1, wherein the backing plates are substantially circular in shape and are rotatably mounted to the support arms.

5. The window blind cleaning system, as described in claim 1, wherein the cleaning pads are removably attached to the inner surfaces using means selected from the group consisting of:

adhesive, snaps, hook and loop fasteners, snap-on brackets and clamps.

6. The window blind cleaning system, as described in claim 1, wherein a plurality of attachment slots are disposed upon the outer surface of the backing plates for attaching a cleaning cloth over the cleaning pads.

7. The window blind cleaning system, as described in claim 1, wherein the cleaning pads are sponge-like air-filled members.

8. The window blind cleaning system, as described in claim 1, wherein the handle is comprised of at least two sections that are removably joined together to provide a compact system capable of extended reach.

9. The window blind cleaning system, as described in claim 1, wherein the handle is comprised of at least two telescoping sections that extend to vary a length of the handle.

10. The window blind cleaning system, as described in claim 1, wherein the second end of the handle is adapted to fit a handle extension to further extend a reach of the system.

11. The window blind cleaning system, as described in claim 1, wherein the trigger further comprises a cam-locking mechanism, the mechanism maintaining the actuating link in the retracted position against the outward urging of the support arms.

12. The window blind cleaning system, as described in claim 1, wherein the trigger is a pivoting lever attached adjacent the second end of the handle.

13. The window blind cleaning system, as described in claim 1, wherein the trigger is a sliding sleeve disposed about the handle adjacent the second end of thereof.

14. The window blind cleaning system, as described in claim 1, wherein the actuating link is disposed adjacent an outer surface of the handle.

15. The window blind cleaning system, as described in claim 1, wherein the actuating link is disposed within a hollow core of the handle.

16. The window blind cleaning system, as described in claim 1, further comprising a U-shaped restraining bar, the restraining bar being formed of resilient material, extending from the outer surface of the first backing plate to the outer surface of the second backing plate and further urging the backing plates apart.

17. The window blind cleaning system, as described in claim 1, wherein the backing plates with attached cleaning pads are removably attached to the support arms.

18. The window blind cleaning system, as described in claim 1, further comprising:

a container, the container containing a cleaning fluid and being secured to the handle;

a tube, the tube extending from the container to at least one of the cleaning pads; and whereby, when the bottle is either of tilted and squeezed, a quantity of cleaning fluid will be dispensed onto the cleaning pad.

19. A window blind cleaning system, comprising:

first and second backing plates, each of the backing plates having an inner surface and an outer surface;

the inner surfaces being sized and shaped to conform to a shape of a window blind;

first and second cleaning pads, the cleaning pads being sized and shaped to cover the inner surfaces;

means for attaching the cleaning pads to the inner surfaces;

first and second support arms, each of the support arms having an upper end, a lower end, being formed of resilient material, pivotally mounted to one of the outer surfaces at the upper end and fixedly attached adjacent a first end of a handle at the lower end;

the first support arm holding the first backing plate with attached cleaning pad in a fixed position;

the second support arm further comprising a pivot point, the pivot point disposed outwardly from a centerline of the handle;

an actuating arm, the arm having a top end, a bottom end, a point of rotation, being pivotally mounted to the second support arm at the pivot point, bearing against the outer surface of the second backing plate at the top end and attached to a first end of an actuating link at the bottom end;

the actuating link being disposed substantially parallel to the handle and connecting at a second end to a trigger, the trigger being pivotally attached adjacent a second end of the handle;

the trigger moving the actuating link from an extended position, allowing the second support arm to withdraw the second backing plate from close proximity to the first backing plate, to a retracted position, urging the second backing plate toward the first backing plate and closing the backing plates with attached cleaning pads about the window blind against outward urging of the second support arm; and whereby, when the trigger moves the actuating link to the retracted position the first and second cleaning pads will be clamped on either side of the window blind and are movable along a length of the blind for cleaning, and when the trigger moves the actuating link to the extended position, the support arms will separate the backing plates and the cleaning pads from the blind for removal therefrom.

* * * * *